United States Patent [19]

Montiel

[11] 4,111,504

[45] Sep. 5, 1978

[54] STORAGE FILE AND RETRIEVAL SYSTEM

[76] Inventor: Esteban Montiel, 744 Yates, Romeoville, Ill. 60441

[21] Appl. No.: 803,635

[22] Filed: Jun. 6, 1977

[51] Int. Cl.[2] ..... A47B 63/00

[52] U.S. Cl. ..... 312/183; 312/184; 312/193; 209/547

[58] Field of Search ..... 312/184, 183, 185, 187, 312/188, 193; 209/80.5

[56] References Cited

U.S. PATENT DOCUMENTS

| | | | |
|---|---|---|---|
| 454,265 | 6/1891 | Fezandie | 312/185 |
| 815,785 | 3/1906 | Bennett | 312/193 |
| 1,186,470 | 6/1916 | Eddy | 209/80.5 |
| 1,256,450 | 2/1918 | Eddy | 209/80.5 |
| 1,276,503 | 8/1918 | Eddy | 209/80.5 |
| 1,285,793 | 11/1918 | Reeves | 312/193 |
| 1,317,142 | 9/1919 | MacNab | 209/80.5 |
| 1,406,226 | 2/1922 | Ridge | 209/80.5 |
| 1,727,453 | 9/1929 | Tockhorn | 209/80.5 |
| 3,604,775 | 9/1971 | Anderson | 312/330 |
| 3,716,283 | 2/1973 | Little | 312/183 |

FOREIGN PATENT DOCUMENTS

| | | | |
|---|---|---|---|
| 1,060,842 | 1954 | France | 312/184 |

*Primary Examiner*—Victor N. Sakran
*Attorney, Agent, or Firm*—Dressler, Goldsmith, Clement, Gordon & Shore, Ltd.

[57] ABSTRACT

A storage file and retrieval system for readily locating and retrieving file folders and the like. The storage file and retrieval system includes a cabinet with one or more slidable drawers into which a plurality of index folder assemblies are stored. Each index folder assembly includes a file folder with an upwardly extending tab having a striker face. The striker faces of the various index folder assemblies are sequentially spaced from each other so as to be located in different striking positions. A reset bar is mounted to the interior of the cabinet to tilt the index folder assemblies forwardly toward the front wall of the drawer when the drawer is closed. In order to readily locate and retrieve a preselected file folder, a movable selector having a striker arm is operatively connected to the cabinet for engaging the striker face of the preselected file folder when the drawer is opened so as to cause the preselected file folder and the other folders behind the preselected file folder to tilt rearwardly toward the back wall of the drawer and thereby be separated from the other file folders in front of the preselected file folder.

1 Claim, 9 Drawing Figures

FIG. 3
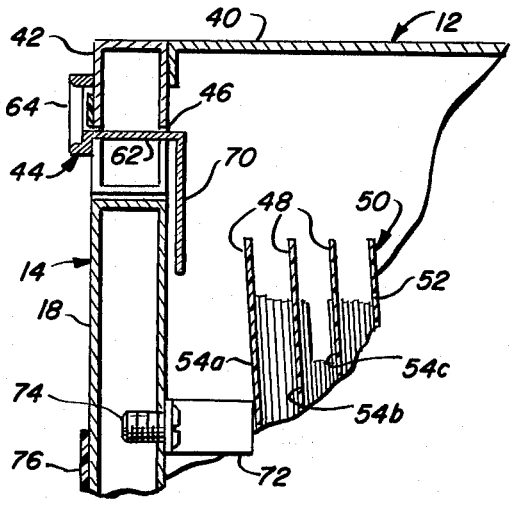
FIG. 1
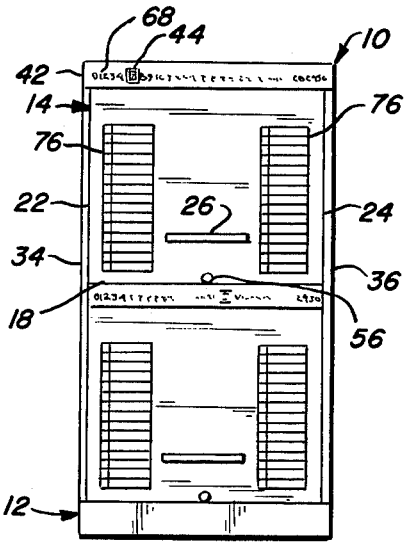
FIG. 2
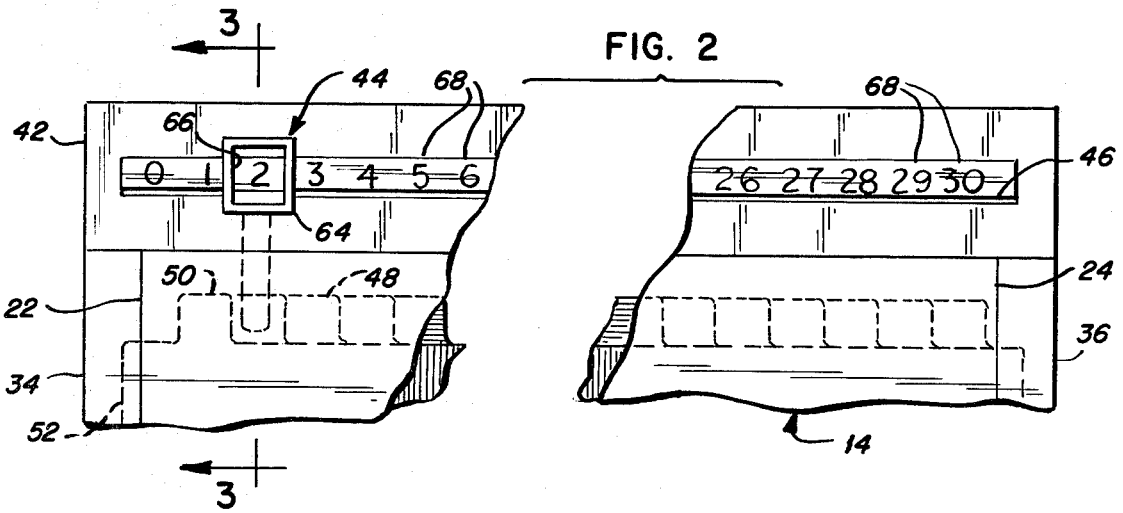
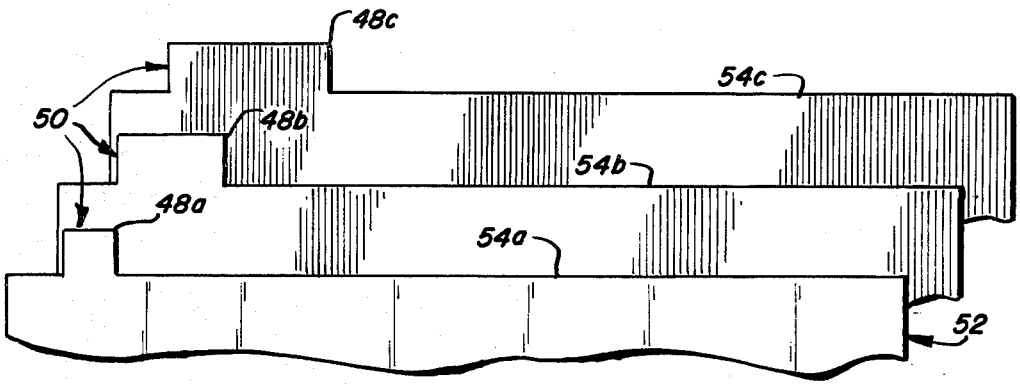
FIG. 4

STORAGE FILE AND RETRIEVAL SYSTEM

BACKGROUND OF THE INVENTION

This invention relates to an index filing system, and more particularly, to a storage file and retrieval system for a file cabinet and the like.

Business offices typically have at least one file cabinet, and usually a multitude of file cabinets, for storing voluminous amounts of file folders and papers. Because of the vast number of folders and papers stored in these cabinets, it is often tedious, time-consuming and difficult to readily locate a particular file or set of papers. Furthermore, once the desired file folder or papers are located, it is often cumbersome and difficult to easily remove the file folder or papers from the cabinet.

Over the years a number of devices have been developed in an attempt to solve the preceding problems. One such device is found in U.S. Pat. No. 1,317,142 which utilizes a pin for clamping an index card to make it difficult to displace the index card out of its normal position. Other types of devices have a variety of linkages, gears or other elements for elevating an index card or file folder. Typical of such devices are those disclosed in U.S. Pat. Nos. 1,186,470; 1,256,450; 1,276,503; 1,366,427; 1,382,004; 1,406,226; 1,499,159 and 1,727,453. These prior art devices have met with varying degrees of success.

It is therefore desirable to provide a device which overcomes the preceding disadvantages.

SUMMARY OF THE INVENTION

A storage file and retrieval system is provided, which permits file folders to be readily located and easily removed.

In accordance with principles of the present invention, the storage file and retrieval system includes a cabinet into which one or more slidable drawers are housed. Each drawer has a bottom and end walls, including a front wall and a back wall, that extend upwardly from the bottom and a pair of elongated side walls extending between the end walls. A handle is attached to the front wall to permit the drawer to be pulled from a closed position to a partially opened engagement position, to a fully opened position and subsequently to be moved back to its closed position.

The cabinet is constructed and arranged to define compartments into which the drawers slide. Each compartment has an undercarriage with at least one elongated rail for slidably supporting and guiding the bottom of the drawer. A pair of upright side walls provides the sides of the compartment and a rear wall provides the back of the compartment. The compartment also includes a front face plate positioned adjacent the front wall of the drawer when the drawer is closed.

A plurality of index folder assemblies are stored in the drawer generally vertically across the drawer in side-by-side relationship. Each index folder assembly includes a file folder and a tab extending upwardly from the file folder. Each tab has a striker face which is positioned in a different striker position.

A reset bar is connected to the cabinet to tilt the index folder assemblies toward the front wall of the drawer when the drawer is closed.

One of the features of the present invention is the inclusion of a movable selector having a striker arm for engaging and striking the striker faces of the tabs. The selector is operatively connected to the cabinet and is constructed and arranged to be selectively movable to a plurality of positions corresponding and aligned with the various striker faces of the tabs. When the drawer is moved to a partially opened engagement position the striker arm will abuttingly engage and push against the striker face of the preselected file folder and cause that folder and folders behind the preselected folder to tilt rearwardly toward the back wall of the drawer and be separated and angularly displayed from the remaining file folders which are tilted toward the front wall of the drawer.

Preferably, the back wall of the drawer is of a lesser height than the rear wall of the cabinet and the reset bar includes an elongated bar which is cantilevered from the rear wall of the cabinet and extends longitudinally into the interior of the cabinet. The reset bar is desirably positioned above and forwardly of the back wall of the drawer when the drawer is in a closed position to engage the index folder assemblies.

In the preferred form, the front face plate of the cabinet defines an elongated lateral slot. Indicia are provided on the face plate of the cabinet adjacent the slot to identify each of the index folder assemblies and the striker face locations of their attached tabs.

In the illustrative embodiment the removable selector includes a pin for sliding along the slot. A handle is provided for grasping the pin. The handle defines an indicator for indicating the particular indicia on the front face plate. Most preferably, the striker arm extends downwardly from the pin within the interior of the cabinet to a level in generally horizontal alignment with the striker faces of the tabs.

A more detailed explanation of the invention is provided in the following description and appended claims taken in conjunction with the accompanying drawings.

BRIEF DESCRIPTION OF THE DRAWINGS

FIG. 1 is a front view of a storage file and retrieval system in accordance with principles of the present invention;

FIG. 2 is an enlarged fragmentary front view of a portion of the front face plate of the cabinet and the removable selector;

FIG. 3 is a fragmentary cross-sectional side view of the storage file and retrieval system taken substantially along line 3—3 of FIG. 2;

FIG. 4 is an enlarged fragmentary front view of some of the index folder assemblies;

DETAILED DESCRIPTION OF THE ILLUSTRATIVE EMBODIMENT

The drawings illustrate a storage file and retrieval system 10 for storing, organizing and retrieving a multitude of file folders and papers. The storage file and retrieval system 10 is particularly useful in a business office or the like where it is necessary to store, locate and retrieve a voluminous amount of file folders and papers.

In the illustrative embodiment the storage file and retrieval system 10 includes a file cabinet 12 into which are housed one or more slidable drawers 14. The file cabinet 12 is depicted for purposes of illustration only and it is comtemplated that the cabinet 12 can includes the cabinet or frame assembly of a desk or othr furniture into which a drawer 14 can slide.

In the illustrative embodiment the file cabinet 12 and the drawer 14 are made out of sheet metal. Other materials, however, can be used when desired, such as wood, impact-resistant plastic or cardboard.

Figure 5:
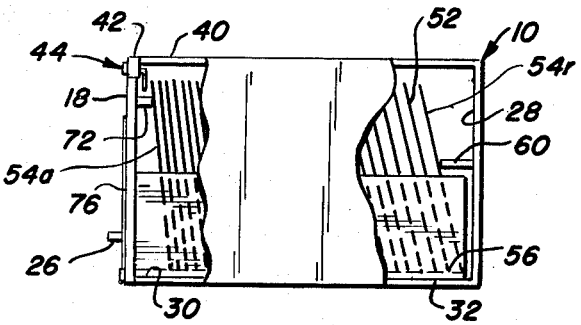
FIG. 5 is a fragmentary cross-sectional side view of the storage file and retrieval system with the drawer in a closed position.

The drawer has a bottom 16 (FIG. 8) and a pair of end walls including a front wall 18 and a back wall 20 which extend upwardly from the bottom of the drawer. A pair of elongated side walls 22 and 24 (FIG. 1) extend in general parallel relationship between and connect the end walls 18 and 20. A handle or a knob 26 (FIG. 1) is attached to the exterior surface of the front wall 18 to provide a manually graspable surface in which a secretary or file clerk or other person can pull the drawer from a closed position (FIG. 5) to a partially opened engagement position (FIGS. 6 and 7) and subsequently to a fully open position (FIG. 9) and thereupon push or move the drawer back to its closed position (FIG. 5).

The file cabinet 12 generally defines a compartment 28 (FIG. 7) into which the drawer 14 slides. The cabinet has an undercarriage 30 with at least one elongated rail 32 and preferably a pair of rails for slidably supporting and guiding the bottom 16 of the drawer 14. A pair of upright side walls 34 and 36 (FIG. 1) provides the sides of the compartment 28 and generally extends above the undercarriage 30. The rear wall 38 (FIG. 7) of the cabinet extends between and connects the upright side walls 34 and 36 and provides the back of the compartment 28. The top 40 of the cabinet 12 is connected to the rear wall 38, and generally covers the drawer 40 when the draw3er is closed (FIG. 5). The front face plate or peripheral front frame 42 is positioned in general parallel relationship with the rear wall 38 of the cabinet 12 so as to be located adjacent the front wall 18 of the drawer 14 when the drawer 14 is in a closed position (FIGS. 3 and 5). The front face plate 42 generally extends between and connects the upright side walls 34 and 36 of the cabinet 12.

In order to provide for slidable movement of the movable selector 44, the front face plate 42 of the cabinet 12 is constructed and arranged to define an elongated lateral slot 46 as best shown in FIG. 2. In the illustrative embodiment the slot 46 extends generally across the width of the front face plate 42 and is generally oblong and straight. In some circumstances, it may be desirable that the slot be curved or be grooved or undercut at various positions to correspond to the striker positions of the striker faces 48 (FIG. 1) of the tabs 50 so that the selector 44 can be removably seated at the grooved or undercut positions.

In order to assist in storing, organizing and retrieving the file folders and papers, a plurality of index folder assemblies 52 (FIG. 9) are housed in the drawer 14. EAch index folder assembly includes a file folder 54 having front and back sides which define a pocket for storing and separating papers and other items. Preferably, the file folders 54 are positioned generally vertically in side-by-side relationship laterally across the drawer 14 between the elongated side walls 22 and 24 of the drawer 14. In the illustrative embodiment the file folder 54 is made of paperboard or the like, although in some circumstances it may be desirable to construct the file folder of flexible impact-resistant plastic or metal.

Desirably, the file folders 54 are removable. When removed, the papers and other items in each file folder 54 can also be removed. It may be desirable, however, in some circumstances that the file folder 54 comprise only a single sheet of paperboard or other material which is slidably secured to the drawer 14 by means of a slide rod 56. In such instances, the papers and other items being stored can be loosely placed between the non-removable file folders or stored in other types of removable "pocket" folders between the non-removable file folders.

To assist in identifying and removing each file folder 54, each index folder assembly 52 includes a tab 50 extending upwardly from each of the file folders 54 as best illustrated in FIG. 4. Each tab 50 has a striker face 48 having a front side facing the movable selector 44 and a rearward side facing the rear wall 38 of the cabinet 12. The striker face 48 of each of the tabs 50 are sequentially spaced apart and located in a different striker position. For example, the striker face **48*a* (FIG. 4) of the first file folder 54*a* is located adjacent the left side of the file folder 54*a*. The striker face 48*b* at the right-hand side of the tab 50 of the second file folder 54*b*, immediately behind the first file folder 54*a*, is spaced slightly to the right of and thereby offset from the first striker face 48*a*. The third striker face 48*c* at the right-hand side of tab 50 of the third file folder 54*c*, immediately behind the second file folder 54*b*, is positioned slightly to the right of the second striker face 48*b***, etc.

Preferably, the striker faces 48 are of a rigid material which is generally resistant to permanent deformation and bending during normal usage. In the illustrative embodiment the striker face 48 and tabs are formed integral with the file folders 54. It may be desirable in some circumstances to form the tabs and striker faces out of metal or impact-resistant plastic and separately attach the tabs to the file folders 54 with a suitable fastener, such as grommets or adhesive.

In the illustrative embodiment the tab 50 of each index folder assembly 52 extends from a common edge on the left-hand side of the folders so that the tabs 50 become sequentially longer as one progresses from the index folder assemblies 52 near the front 18 of the drawer 14 to the back 20 of the drawer 14, but with the striker face 48 of each tab positioned adjacent the right-hand edge of the tab. It may be desirable in some circumstances that the tabs are laterally offset from each other so as not to have a common left-hand edge whereby the tabs would be generally of the same size but spaced sequentially apart toward the right-hand side of the various file folders 54 as one progresses from the index folder assemblies 52 adjacent the front 18 of the drawer 14 to the back 20 of the drawer 14.

A reset bar 60 (FIG. 5) is provided to tilt the index folder assemblies toward the front 18 of the drawer 14 when the drawer 14 is closed. In order to effectively position the reset bar 60, the back wall 20 of the drawer 14 should be of a lesser height than the rear wall 38 of the cabinet 12 as shown in FIG. 5. The reset bar 60 is connected to the cabinet 12, such as by welding or by screws or other fasteners. In the illustrative embodiment the reset bar 60 is solid, elongated and cantilevered from the rear wall 38 of the cabinet 12 and extends longitudinally forwardly into the interior of the cabinet 12 above and forwardly of the back wall 20 of the drawer, i.e., above the rearward portion of the drawer 14 when the drawer 14 is closed. In operation, when the drawer 14 is closed the reset bar 60 engages and pushes against the rearwardmost file folder **54*r* (FIG. 5) causing all the folders 54 to tilt or lean toward the front wall 18 of the drawer 14 in a domino-like effect. In some circumstances, it may be desirable that the reset bar 60 be positioned to engage the rearward side of the striker face 48 attached to the rearward file folder 54*r***.

In order to readily locate, retrieve and remove the index folder assemblies 52, the storage file and retrieval system 10 includes a movable selector 44 operatively connected to the cabinet 12. As best shown in FIGS. 2 and 3, the selector 44 includes a pin or slide bar 62 which slides along the slot 46 of the front face plate 42. A handle or knob 64 extends from the outer end of the pin 62 on the exterior side of the front face plate 42 to provide a surface for manually grasping and moving the pin along the slot 46. In the preferred embodiment the handle is tubular with a rectangular cross-sectional configuration so as to further define an indicating area or means 66 for circumscribing and indicating the various indicia 68 on the front face plate 42.

A striker arm 70 extends downwardly from the inner end of the pin 62 so as to be positioned within the interior of the cabinet 12. Desirably, the striker arm 70 descends to a level in general horizontal alignment with the striker faces 48 of the tabs 50 as best shown in FIG. 3, for engaging the striker faces 48 of the tabs 50. As illustrated in FIG. 3, the maximum height of the tabs 50 is below the height of the front wall 18 of the drawer 14, while the level of striker arm 70 is below the top edge of the front wall 18. Preferably the striker arm 70 is positioned closely adjacent the inner side of the front wall 18 of the drawer 14 when the drawer 14 is closed.

In order to provide for adequate space between the front file folder **54*a* and striker arm 70 one or more spacers 72 (FIGS. 3 and 5) can be fastened to the inner side of the front wall 18 of the drawer 14 such as by screws 74 or other fasteners. In some circumstances it is also desirable to provide file separators or spacers (not shown) on the undercarriage 30 between each adjacent set of file folders 54**.

The indicia 68 on the front face plate 42 is preferably positioned slightly above and adjacent the elongated slot 46. In the illustrative embodiment, the indicia consists of the numbers 0–30 with each number corresponding and indicating the position in when the striker arm 70 is aligned in registration with a different striker face 48 of the tabs 50, except that the number "0" has no corresponding striker face as shown in FIG. 2. In the "0" position all the index folder assemblies 52 can be tilted toward the front 18 of the drawer 14 and untouched by the striker arm 70 when the drawer 14 is pulled open. This "0" position construction and arrangement thus provides the basis and explanation why the leading or left-hand edge of all the tabs 50 are spaced slightly away from the left-hand side of the file folders 54 as shown in FIG. 4.

In the illustrative embodiment there are thirty index folder assemblies 52 each having a tab 50 with a striker face 48 positioned in a slightly different striker position. It may be desirable in some circumstances that the indicia consists of more or less numbers than the thirty numbers depicted in the illustrative embodiment in FIG. 2. Other indicia, such as letters or symbols can also be used.

In order to assist in identifying the contents of each of the file folders 54, one or more sets of labels 76 are desirably attached to the exterior surface of the front wall 18 of the drawer 14 as best shown in FIG. 1. In the illustrative embodiment there are thirty individual labels which comprise the two sets of labels 76. Each label 76 is identified by a number printed thereon, which number corresponds to a different index folder assembly 52. Each of the labels has an elongated area upon which can be typed or written a brief description of the contents of the particular file folder 54.

Figure 6:
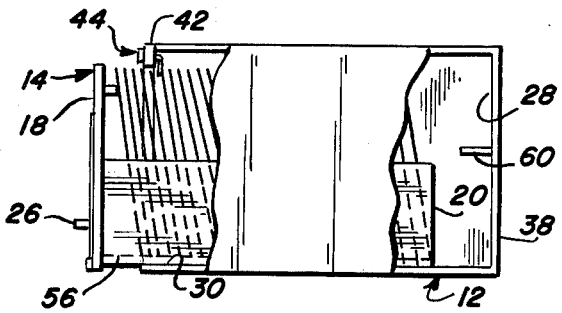
FIG. 6 is a view similar to FIG. 5, but with the drawer in a partially opened position when the index folder assemblies initially engage the striker arm of the movable selector.
Figure 7:
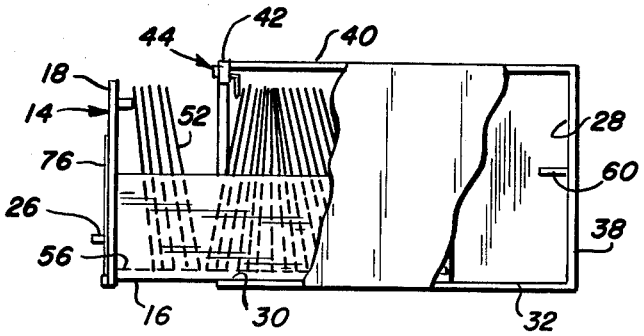
FIG. 7 is a view similar to FIG. 6, but with the drawer in a position in which the striker arm of the movable selector is pushing and tilting some of the index folder assemblies toward the back wall of the drawer.

In order to locate and retrieve a file, a person need only identify the location number or indicia 68 from the label 76 which corresponds to the contents of the file folder 54 that the person wants to retrieve. The selector 44 can then be moved to the identified location number and the drawer can be opened. As the drawer 14 is being opened the striker arm 70 of the selector 44 will abuttingly engage and push against the striker face 48 of the preselected file folder 54. This initial engagement position is best illustrated in FIG. 6 and generally defines an initial engagement position when the drawer 14 is partially opened. As the drawer 14 is continued to be pulled outwardly toward the fully opened position, the striker arm 70 of the selector 44 will continue to push against the preselected file folder as best shown in FIG. 7, and cause the preselected file folder 54 as well as the other file folders positioned behind the preselected file folders 54 (i.e., the other file folders positioned between the preselected file folder and the back wall 20 of the drawer 14) to tilt toward the back wall 20 of the drawer 14. Such rearward tilting causes the preselected file folder and the file folders positioned behind the preselected file folder to be separated and angularly displaced from the remaining file folders positioned in front of the preselected file folder, i.e., between the preselected file folder and the front wall 18 of the drawer 14.

Figure 8:
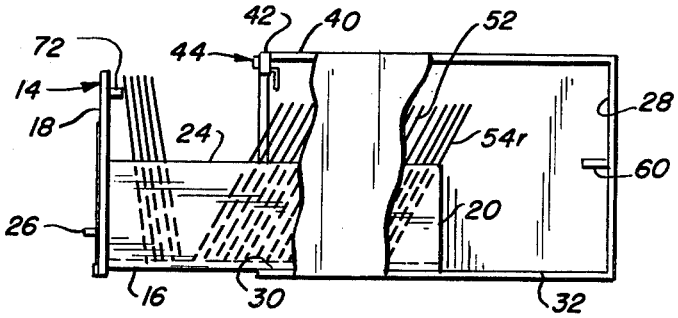
FIG. 8 is a view similar to FIG. 7 after some of the index assemblies have been tilted toward the back wall of the drawer.
Figure 9:
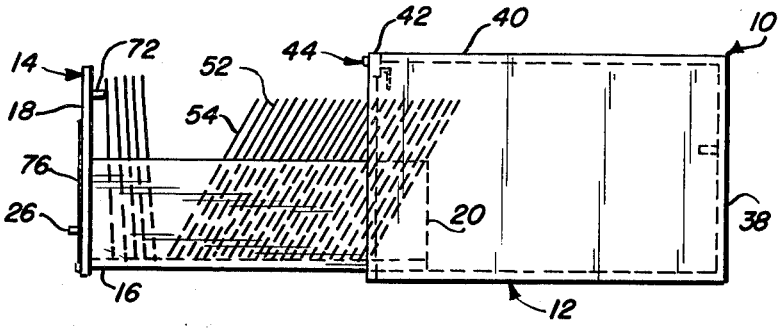
FIG. 9 is a view similar to FIG. 5, but with the drawer substantially in a fully opened position.

The file folders 54 are positioned to tilt rearwardly at a sufficient angle so that the tabs 50 of the index folder assemblies 52 are positioned below and clear the striker arm 70 of the selector 44 as the drawer 14 is pulled outward to the clearance position as best shown in FIG. 8 after the striker arm 70 has engaged the tabs 50. The drawer can then be opened to the fully opened position as depicted in FIG. 9 for ease of access to the preselected file folder 54.

When the drawer 14 is closed as shown in FIG. 5, the reset bar 60 will push against the rearward side of the rearward file folder **54*r* and cause all the file folders 54 to tilt forwardly toward the front wall 18 of the drawer 16 with the first file folder 54*a* generally leaning against the spacer 72 as best shown in FIGS. 3 and 5**.

Although an embodiment of this invention has been shown and described, it is to be understood that various modifications and substitutions can be made by those skilled in the art without departing from the novel spirit and scope of this invention.

What is claimed and desired to be protected and secured by Letters Patent of the United States is:

1. A storage file and retrieval system, comprising:

a drawer having a bottom, end walls extending upwardly from said bottom including a front wall and a back wall, a pair of elongated side walls extending between said end walls and a handle attached to said front wall for permitting said drawer to be pulled from a closed position to a partially opened engagement position, to a fully opened position and be moved back to said closed position;

a cabinet defining a compartment into which a drawer slides and having an undercarriage with at least one elongated rail for slidably supporting and guiding the bottom of said drawer, a pair of upright side walls defining the sides of the compartment, a rear wall extending between said upright side walls and defining the back of the compartment, said rear wall extending upwardly to a height above the back wall of said drawer, and a front face plate extending between said upright side walls and positioned adjacent the front wall of said drawer when said drawer is in a closed position and defining an elongated lateral slot;

index folder means including a plurality of file folders disposed generally vertically in side-by-side relationship laterally across said drawer between said elongated side walls for storing and separating papers and tab means extending upwardly from each of said file folders, said tab means each having a striker face disposed generally in a different striker location;

said front face plate having indicia thereon adjacent said slot and corresponding to said striker faces of said tab means and the locations of said file folders;

reset means connected to said cabinet for engaging said index folder means and causing said file folders to tilt toward the front wall of the drawer when said drawer is closed, said reset means including an elongated bar cantilevered from the rear wall of the cabinet and extending longitudinally into the interior of said cabinet above and forwardly of the back wall of the drawer when said drawer is in said closed position; and movable selector means including a pin for sliding along said slot, handle means for grasping said pin and for permitting said selector means to be selectively moved, said handle means defining indicator means for indicating the particular indicia on said front face plate and a striker arm extending downwardly from said pin means within the interior of the cabinet to a level in general horizontal alignment with said striker faces of said tab means, said selector means being movable to a plurality of positions with each position corresponding to one of said indicia to indicate when said striker arm is aligned in registration with a striker face of said tab means so that when said drawer is moved to said partially opened engagement position and subsequently moved to said fully opened position said striker arm will abuttingly engage and push against said corresponding striker face of one of said file folders and cause said one file folder and the other file folders disposed between said one file folder and said back wall of said drawer to tilt toward the back wall of the drawer and be separated and angularly displaced from the remaining folders between said one folder and the front wall of said drawer.

* * * * *

UNITED STATES PATENT AND TRADEMARK OFFICE

CERTIFICATE OF CORRECTION

PATENT NO. : 4,111,504

DATED : September 5, 1978

INVENTOR(S) : Esteban Montiel

It is certified that error appears in the above-identified patent and that said Letters Patent are hereby corrected as shown below:

Col. 3, line 16, "othr" should be --other--.
Col. 3, line 47, "draw3er" should be --drawer--.
Col. 4, line 2, "EAch" should be --each--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*